United States Patent [19]

Simmons et al.

[11] Patent Number: 4,473,222

[45] Date of Patent: Sep. 25, 1984

[54] SHEET HANDLING APPARATUS

[75] Inventors: William J. Simmons; Richard L. Tinder, both of Rochester, N.Y.

[73] Assignee: Eastman Kodak Company, Rochester, N.Y.

[21] Appl. No.: 362,437

[22] Filed: Mar. 26, 1982

[51] Int. Cl.[3] ..... B65H 9/06

[52] U.S. Cl. ..... 271/245; 271/255

[58] Field of Search ..... 271/245, 246, 247, 253, 271/254, 255, 243, 244

[56] References Cited

U.S. PATENT DOCUMENTS

| | | | |
|---|---|---|---|
| 1,011,009 | 12/1911 | Bakke | 271/251 |
| 1,159,011 | 11/1915 | Garlick | 271/253 |
| 3,072,397 | 1/1963 | Kelchner | 271/53 |
| 3,256,009 | 6/1966 | Reilly | 271/60 |
| 3,517,923 | 6/1970 | Hoffman | 271/53 |
| 3,558,223 | 1/1971 | Hemphill | 355/23 |
| 3,630,519 | 12/1971 | Spear | 271/53 |
| 3,682,472 | 8/1972 | Barthel | 271/254 |
| 3,804,507 | 4/1974 | Koch | 271/53 |
| 3,902,715 | 9/1975 | Hubler | 271/243 |
| 4,019,732 | 4/1977 | Hunt | 271/245 |
| 4,019,733 | 4/1977 | Montalto | 271/245 |
| 4,132,401 | 1/1979 | Gauronski | 271/245 |

*Primary Examiner*—Duane A. Reger
*Assistant Examiner*—John A. Carroll
*Attorney, Agent, or Firm*—William F. Noval

[57] ABSTRACT

An adjustable sheet handling apparatus including a member which engages a sheet movable along a path and which is movable into and out of the path and a member for holding the sheet engaging member in the sheet path. The engaging member and holding member are adjustably connected so the position in the path at which a sheet is engaged by the sheet engaging member may be changed without changing the position of the holding member.

9 Claims, 9 Drawing Figures

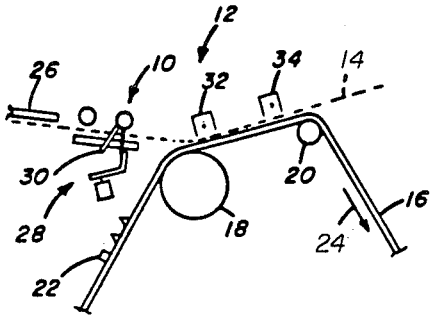
FIG. 1
FIG. 2
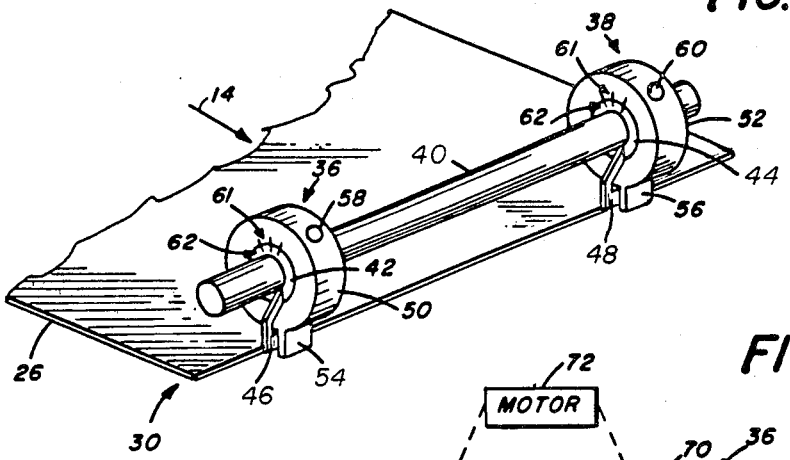
FIG. 3
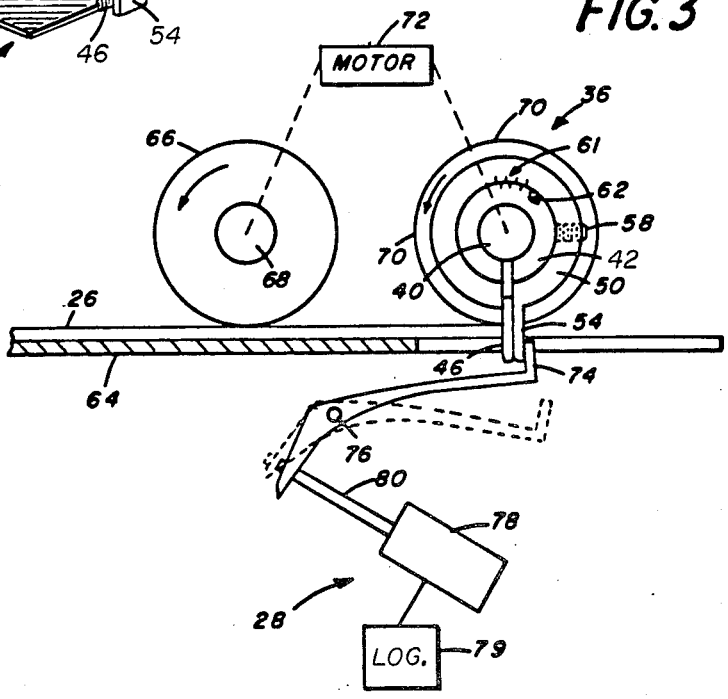

SHEET HANDLING APPARATUS

BACKGROUND OF THE INVENTION

The invention relates to sheet handling apparatus and more particularly to apparatus for aligning and registering sheets moved along a path seriatim to a workstation.

In high-speed reproduction equipment such as electrophotographic copiers, copy sheets are moved seriatim into registration with transferable toner images on a moving transfer member prior to transfer of the toner images to the sheets. A registration mechanism typically intercepts a sheet in advance of the transfer member and either stops it or slows it down in order to synchronize the sheet with an image on the image transfer member. The registration mechanism also effects proper lateral alignment of the copy sheet prior to delivery to the image transfer member by correcting skew in the sheet. Such registration mechanism may take the form of two laterally spaced registration members which are moved into and out of the path of the copy sheet. A misaligned copy sheet striking one of the members will be moved into contact with the other member to properly align the sheet with respect to the image to be transferred. At a preselected time the registration members are moved out of the sheet path and the sheet moved into registration with an image on the transfer member.

One form of registration mechanism is illustrated in commonly assigned U.S. Pat. No. 4,019,733 in which a registration disc is positioned between a pair of continuously driven rollers which contact the disc by means of thrust washers. The registration disc has a registration finger which extends into a sheet path and which is latched to prevent rotation of the disc. A pair of laterally spaced registration discs provide alignment and skew correction. At predetermined time intervals, the registration fingers are unlatched, the discs are rotated with the driven rollers to move the registration fingers out of the sheet feed path, and a copy sheet is fed by the rollers into registration with a toner image on an image transfer member. Although the sheet registration mechanism disclosed in the aforementioned patent has been successfully used for the purpose for which it was intended, difficulties have arisen in adjusting the registration discs with respect to each other. Such adjustments necessitate either movement of the shaft which mounts the nip rollers and registration discs or movement of the latch mechanisms. Adjustments of either the shaft or latch mechanisms are undesirable for several reasons. Movement of the entire nip roller shaft may introduce inaccuracies in timing and alignment of copy sheets fed by the nip rollers which are also mounted on the shaft. It would thus be desirable to be able to correct the alignment of the registration discs without having to also move the sheet feed rollers. Moreover, movement of the latch mechanism may necessitate re-timing of the entire electrographic cycle, a complex and time-consuming task requiring shutdown of the electrographic copier.

Thus, it would be desirable to have the benefits of the simple and efficient design of sheet registration mechanism disclosed in U.S. Pat. No. 4,019,733. It would also be desirable for adjustment of the registration fingers to be effected quickly by a serviceperson without having to tamper with the operation of the sheet feed rollers or of the latching mechanism.

SUMMARY OF THE INVENTION

According to the present invention, there is provided sheet handling apparatus which permits easy adjustment of the apparatus for skew correction of copy sheets registered and aligned by the apparatus. The apparatus provides positive indicia for permitting simple and accurate adjustments to be made to the apparatus by a service representative.

According to said invention, adjustable sheet handling apparatus is provided comprising means selectably movable into and out of a path for engaging a sheet moved along the path, means for holding said means for engaging in said path and means for adjustably connecting said means for holding and said means for engaging so that the position in the path at which a sheet is engaged by said means for engaging may be changed without changing the position of said means for holding.

According to an aspect of the invention, complementary indicia means are provided on said means for engaging and said means for holding for facilitating adjustment of said means with respect to each other. According to another aspect of the invention, the means for engaging includes a first annular member having at least one radially extending registration finger for engaging a sheet moved along a path, said means for holding includes a second annular member having a second radially extending detent finger and said means for adjustably connecting said means for engaging and said means for holding includes means for mounting said first and second annular members for relative rotational movement with respect to each other. According to another aspect of the invention, indicia means comprising complementary slot means on the first and second annular members are provided for facilitating adjustment of said members by means of an adjusting tool insertable into said slots.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, like numbers indicating like elements in which;

FIG. 1 is a diagrammatic view of a part of an electrophotographic copier incorporating the sheet handling apparatus of the present invention;

FIG. 2 is a perspective view of a sheet handling apparatus according to the present invention disposed across the path of travel of a copy sheet;

FIG. 3 is an elevational view of the sheet handling apparatus of FIG. 1;

DESCRIPTION OF THE PREFERRED EMBODIMENT

Figure 4:
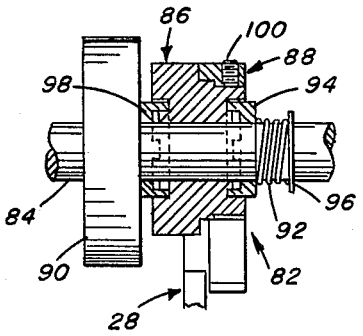
FIG. 4 is a front elevational view of another embodiment of sheet handling apparatus according to the present invention.

As shown in FIG. 1, electrographic apparatus 12 incorporates sheet handling apparatus 10 according to the present invention to register copy sheets 26 such as paper moved along path 14 supplied seriatim from supply hoppers (not shown). Apparatus 12 includes a photoconductive belt 16 trained about rollers 18 and 20 and having thereon transferable toner images 22 formed by electrophotographic techniques well known to those skilled in the art. Such techniques are disclosed and described in commonly assigned U.S. Pat. No. 3,914,047 which is incorporated herein by reference. Belt 16 is moved in the direction of arrow 24. Sheet handling apparatus 10 momentarily stops or slows down copy sheet 26 to eliminate any skew in the copy sheet transverse of the path and to synchronize the positioning of the leading edge of sheet 26 with image 22 on belt 16. At a predetermined time, latch mechanism 28 is actuated to release registration fingers 30 so that they move out of path 14. Sheet 26 is now free to be moved into registration with toner image 22 in advance of transfer charger 32 which effects transfer of image 22 to copy sheet 26.

Detack charger 34 neutralizes any remaining charge on copy sheet 26 which separates from belt 16 at roller 20. Sheet 26 is then transported to a suitable fixing station (not shown) where toner image 22 is fixed to sheet 26 and thereafter to an output tray or the like.

Referring now to FIG. 2, there is shown in greater detail but still in diagrammatic form one embodiment of sheet handling apparatus according to the present invention. As shown, a pair of registration rollers 36 and 38 are mounted on shaft 40. Registration rollers 36 and 38 respectively have inner annular members 42 and 44 with sheet registration fingers 46 and 48 and outer annular members 50 and 52 rotatably disposed respectively on inner annular members 42 and 44. Members 50 and 52 respectively have detent fingers 54 and 56 and are locked with respect to inner members 42 and 44 by screws 58 and 60, respectively. Complementary indicia 61 and 62 on members 50 and 42 and members 52 and 44 respectively provide a visual aid to an operator when moving the members relative to each other to adjust registration fingers 46 and 48.

As shown in FIG. 2, copy sheet 26 is moved along a path as indicated by arrow 14 and is momentarily contacted by registration fingers 46 and 48.

Referring now to FIG. 3, copy sheet 26 is shown urged along guide member 64 by feed roller 66 of soft rubber. Sheet 26 is momentarily slowed or stopped by registration finger 46.

Annular member 42 is rotatably mounted on shaft 40 upon which feed roller 70 is fixedly mounted. Feed roller 66 is mounted on shaft 68 in advance of roller 70. Motor 72 is mechanically linked to shafts 40 and 68 and continuously drives rollers 66 and 70.

Registration roller 36 is linked to roller 70 by a clutch mechanism (to be described later with respect to the embodiment shown in FIGS. 4–9) which continuously urges roller 36 out of the path of a copy sheet 26. Such urging is resisted, however, by latch mechanism 28 which includes latch member 74 pivotally mounted at pivot 76 and driven by a solenoid 78 having a rod 80 connected to latch member 74. As shown in solid lines in FIG. 3, latch member 74 engages detent finger 54 to prevent rotation of roller 36 by roller 70. However, at a predetermined time, solenoid 78 is actuated by logic and control 79 to actuate rod 80 to move latch member 74 to the dotted position shown in FIG. 3 out of contact with finger 54. The clutch mechanism then transmits a rotational force from continuously rotating roller 70 to roller 36 (and roller 38) to move registration finger 46 out of the path of copy sheet 26 to permit it to be fed along path 14 by rollers 66 and 70 into registration with a toner image 22 on belt 16.

After copy sheet 26 has cleared rollers 66 and 70, latch member 74 will once again be engaged with detent finger 54 so that roller 36 will be positioned to register the next succeeding copy sheet 26.

Referring now to FIGS. 4–9, there is shown in greater detail another embodiment of sheet handling apparatus according to the present invention. As shown in FIG. 4, a registration roller 82 is rotatably mounted on shaft 84 and includes inner annular member 86 and outer annular member 88 rotatably mounted on member 86. Member 86 is freely mounted on shaft 84. A sheet feed roller 90 is fixedly mounted on shaft 84. Registration roller 82 is urged against feed roller 90 by means of a spring 92 coiled about shaft 84 and compressed between clutch member 94 frictionally engaged with roller 82 and stop member 96 fixed to shaft 84. A second clutch member 98 is frictionally engaged with rollers 82 and 90.

Annular member 88 is provided with locking screw 100 which locks member 88 with respect to annular member 86. Screw 100 may be loosened by an operator or serviceperson to permit rotational adjustment of member 88 with respect to member 86 and then tightened to prevent further rotational movement between members 86 and 88.

Figure 5:
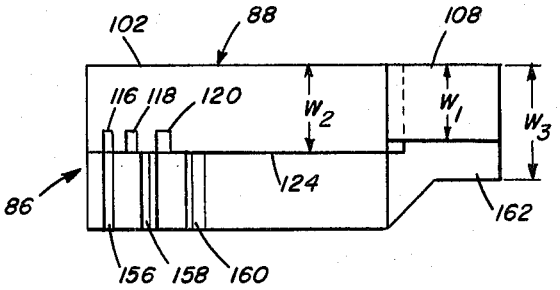
FIG. 5 is a top plan view of the apparatus of FIG. 4.
Figure 8:
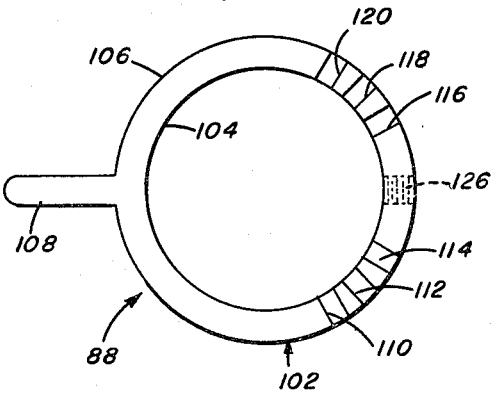
FIG. 8 is side elevational view of the outer annular member of the apparatus of FIG. 4.

As shown more clearly in FIGS. 5 and 8, outer annular member 88 comprises ring member 102 having an inner annular wall 104 and an outer annular wall 106. Member 102 has a detent finger 108 projecting therefrom. Finger 108 has a width $w_1$ which is less than the width $w_2$ of ring member 102.

Ring member 102 is provided with a plurality of slots 110, 112, 114, 116, 118, and 120 which extend through the thickness of member 102 along edge 124 thereof. Threaded aperture 126 also extends through member 102 and accepts screw 100 therein.

Figure 6:
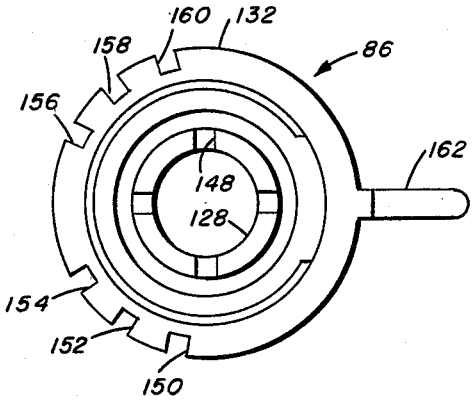
FIG. 6 is a side elevational view of the inner annular member of the apparatus of FIG. 4.
Figure 7:
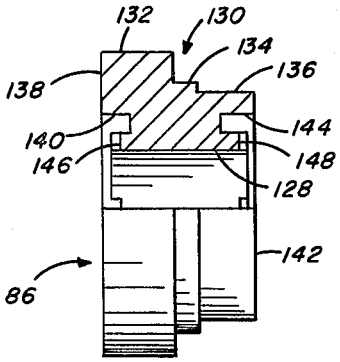
FIG. 7 is a partially sectional front elevational view of the member of FIG. 6.

Referring now to FIGS. 6 and 7 there is shown in more detail the structure of inner annular member 86. As shown, member 86 includes an inner annular wall 128 and an outer annular wall 130 having stepped segments 132 and 134. Segment 134 has a further recessed segment 136 extending partway around segment 134.

Member 86 also has a first side wall 138 having an annular recess 140 therein and a second side wall 142 having an annular recess 144 therein. Slots 146 extend through from annular recess 140 to wall 128 and slots 148 extend through from annular recess 144 to wall 128.

Disposed in segment 132 of outer wall 130 of member 86 is a plurality of slots 150, 152, 154, 156, 158, and 160 which extend through the width of segment 132. Slots 150–160 of member 86 are angularly displaced with respect to slots 110–120 of annular member 88 (FIG. 5) and form therewith aligning means for allowing quick and accurate adjustment of member 88 with respect to member 86. Member 86 is also provided with a detent finger 162 of width $w_3$ greater than the width $w_1$ of registration finger 108. Thus, when member 88 is mounted on member 86, registration finger 108 abuts a portion of latching finger 162 which acts as a stop for member 88. A portion of 162 not covered by member 108 is engaged by latch member 74 of latching mechanism 28.

Figure 9:
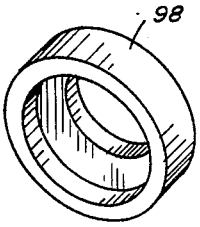
FIG. 9 is a side elevational view of the clutch member of FIG. 4.

As shown in FIGS. 4 and 9, clutch members 98 and 94 are cup-shaped and are dimensioned to fit into recesses 140 and 144 respectively of annular member 86. Members 94 and 98 are rotationally free both on shaft 84 and with respect to member 86. Member 98 also frictionally engages both roller 90 and annular member 86. When latch mechanism 28 latches roller 82, clutch members 94 and 98 rotate with shaft 84. Since they are also in contact with stationary roller 82, slots 146 and 148 scrape the surfaces of clutch members 94 and 98 to remove contaminants which may be removed later by a serviceperson.

Adjustment of registration roller 82 to correct for misalignment or skew of a copy sheet may be effected as follows: a serviceperson or operator first unloosens screw 100 to free member 88 from locking engagement with member 86. Member 88 may be then rotated with respect to member 86 to align one of slots 110–120 with one of slots 150–160. A suitable tool such as a screwdriver may then be inserted to bridge two aligned slots and held there while screw 100 is tightened once more to lock member 88 with respect to member 86. Slots 150–154 are complementary with slots 110–114 and slots 156–160 are complementary with slots 116–120 to permit adjustment of registration roller 82 from either of two directions. The complementary series of slots provide a visual scale for preselected adjustment of member 88 with respect to member 86. The preselected adjustments may represent angles of lateral misalignment (skew) of a copy sheet so that an observed angle of misalignment of a copy sheet may be quickly and simply compensated for by a known adjustment of member 88 with respect to member 86.

Although alignment indicia on the rotatably adjustable members of the sheet handling apparatus of the present invention are desirable to simplify adjustment procedures, they are not essential. Moreover, other types of indicia may be provided to simplify such procedures. For example, scale lines may be provided on the outer surfaces of members 86 and 88 to facilitate adjustment of member 88 with respect to member 86 or the lines may be provided on the sides of the adjustable members as shown in the embodiment of FIG. 2. Any other suitable indicia may be provided which are well known to those skilled in the art.

Thus it is seen that there is provided sheet handling apparatus for registering and aligning sheets moved along a path which permits quick and simple adjustment of the apparatus to correct for copy sheet misalignment. The sheet handling apparatus is simple and economical and is preferably provided with indicia to facilitate adjustment without complete realignment of a latching mechanism or movement of feed rollers or the like which may need readjustment each time the sheet handling apparatus is readjusted.

The invention has been described in detail with particular reference to preferred embodiments thereof. However, it will be understood that variations and modifications can be effected within the spirit and scope of the invention.

What is claimed is:

1. Apparatus for handling sheets moved seriatim along a path comprising a first annular member having an outer annular wall and having at least one radially extending finger;

a second annular member rotatably mounted on said outer wall of said first member and having a second radially extending finger; said first and second fingers having segments which are circumferentially aligned such that said first finger limits the angle of rotation of said second finger; and said first and second annular members being rotatable with respect to each other so that the position in said path at which a sheet is engaged by said second finger on said second annular member may be changed without changing the position of said first finger on said first annular member.

2. The apparatus of claim 1 including means for locking said first annular member against movement with respect to said second annular member.

3. The apparatus of claim 2 wherein said locking means includes a screw radially extending through said second member and engageable with said outer wall of said first member.

4. The apparatus of claim 1 including complementary indicia means respectively on said first annular member and said second annular member for providing a visual aid for moving said first annular member relative to said second annular member.

5. The apparatus of claim 4 including means for locking said second member against rotation with respect to said first member and wherein said complementary indicia means include means for defining slots on said first and second annular members which are alignable when said members are rotated relative to each other and which are of sufficient dimension to accept an edge of a tool to prevent temporary rotation of said members while said locking means is being locked.

6. The apparatus of claim 1 including third and fourth annular members respectively having third and fourth radially extending fingers said fourth member being rotatably mounted on said third member and said third and fourth fingers having segments which are circumferentially aligned such that said third finger limits the angle of rotation of said fourth finger and said third and fourth annular members being spaced laterally of said first and second annular members across the path of a sheet such that said second and fourth fingers engage a sheet moved along said path to laterally align and register it.

7. A roller for registering a sheet moved along a path comprising:

an inner annular member having an outer annular wall having a first circumferential segment and a second raised circumferential segment, said second segment having a plurality of axially extending slots circumferentially spaced about said segment, an outer annular member rotatably mounted on said first outer wall segment of said inner member, said outer member having a plurality of axially extending slots circumferentially spaced about said outer member and being axially alignable with said slots on said inner member, said inner and outer members respectively having radially extending fingers, one of which registers a sheet moved along a path said fingers respectively having segments which are circumferentially aligned such that the angle of rotation of said outer member about said inner member is limited.

8. The roller of claim 7 including means for locking said outer member against rotation with respect to said inner member and wherein said respective slots on said inner and outer members are of sufficient dimension to accept an edge of a tool to prevent temporary rotation of said members while said locking means is being locked.

9. The roller of claim 7 wherein said plurality of slots on said inner member are spaced apart at different intervals than said plurality of slots on said outer member.

* * * * *